US009791225B2

(12) United States Patent
Seuk

(10) Patent No.: US 9,791,225 B2
(45) Date of Patent: Oct. 17, 2017

(54) CHARGING HANDLE ASSEMBLY

(71) Applicant: Jo Won Seuk, Fayetteville, NC (US)

(72) Inventor: Jo Won Seuk, Fayetteville, NC (US)

( * ) Notice: Subject to any disclaimer, the term of this patent is extended or adjusted under 35 U.S.C. 154(b) by 0 days.

(21) Appl. No.: 15/058,486

(22) Filed: Mar. 2, 2016

(65) Prior Publication Data

US 2016/0258698 A1 Sep. 8, 2016

Related U.S. Application Data

(60) Provisional application No. 62/127,253, filed on Mar. 2, 2015.

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC ..... F41A 3/72; F41A 35/06; F41A 3/66
USPC ..... 89/1.4
See application file for complete search history.

(56) References Cited

U.S. PATENT DOCUMENTS 7,832,322 B1 * 11/2010 Hoel ..... F41A 3/20 42/16
2011/0265636 A1 * 11/2011 Overstreet ..... F41A 3/72 89/1.4
2013/0192113 A1 * 8/2013 Melville ..... F41A 7/00 89/1.4

* cited by examiner

*Primary Examiner* — Stephen M Johnson
(74) *Attorney, Agent, or Firm* — R. Tracy Crump

(57) ABSTRACT

The charging handle assembly uses a magnetic latching mechanism to replace the spring loaded latch mechanism common on conventional M16/AR-15 style weapons. The magnetic latching mechanism consists of magnetically attracting plugs mounted to or within the upper receiver and the charging handle. The magnetic attraction between the adjacent plugs provides the locking force to secure the charging handle in the closed position while still allowing the user to manually pull the handle to the open position when necessary.

16 Claims, 16 Drawing Sheets

CHARGING HANDLE ASSEMBLY

This application claims the benefit of U.S. Provisional Application No. 62/127,253 filed Mar. 2, 2015, the disclosure of which is hereby incorporated by reference.

This invention relates to charging handles for AR style firearms, and in particular a charging handle having a magnetic latching mechanism.

BACKGROUND AND SUMMARY OF INVENTION

M16/AR-15 style rifles use a T-shaped charging handle to manually open the rifle's action and pull the bolt carrier assembly rearward. Heretofore, the charging handle locks into position within the upper receiver using a spring loaded latch lever. As showing in FIGS. 1 and 2 hereof, a conventional charging handle 20 has an elongated pull rod 22 and a T-shaped handle part 24. The T-shaped handle allows a user to pull the charging handle to operate the action by hooking the forefinger and middle finger of the right hand over the ends of the T-handle and pulling it to the rear. A spring loaded L-shaped latch lever 26 is pivotally connected to charging handle 20 by a pivot pin 28. A coil spring 30 forces the hooked end 28 of latch lever 26 to seat within a notch 11 formed in the side of the upper receiver 10, thereby securing the charging handle in a forward position. The latch lever prevents the charging handle from moving rearward except when a user applies pressure to the latch lever, which occurs naturally when deliberately pulling on the crossbar of the charging handle.

The charging handle assembly of this invention uses a magnetic latching mechanism to eliminate the need for a spring loaded latch mechanism found on conventional M16/AR-15 style weapons. The magnetic latching mechanism consists of magnetically attracting plugs or screws mounted to or within the upper receiver and the charging handle. The magnetic attraction between the adjacent plugs provides the locking force to secure the charging handle in the closed position while still allowing the user to manually pull the handle to the open position when necessary.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

The drawings illustrate five different embodiments of the charging handle assembly of this invention. The function of the charging handle of an M16/AR-15 style weapon are well known and understood, and will not be discussed in detail herein. In each embodiment of this invention, the charging handle assembly includes a charging handle and a magnetic latching mechanism in place of the spring lever latching mechanism found in traditional M16/AR-15 style weapons. The charging handle assemblies of this invention are intended for use with conventional M16/AR-15 style upper receivers that are typically forged, cast and/machined from aluminum alloys having low magnetic conductivity. The magnetic latching mechanisms generally consist of magnetically attracting plugs or parts mounted to or within the upper receiver body and the charging handle. The magnetically attracting plugs and parts may be composed of oppositely poled magnetic material, such as an earth magnet, or a magnetically attracting material, such as a ferrous metal material. The magnetic attraction between the adjacent ferrous and magnetic plugs provides the locking force to secure the charging handle in the closed position while still allowing the user to manually pull the handle to the open position when necessary.

In each embodiment, the charging handle has an elongated pull rod member and an integral T-handle. The pull rod terminates at its forward end with a hook (not shown) that engages a bolt (not shown). The bolt reciprocates within the upper receiver between a closed position in which the bolt is forward, and an open position in which the bolt is shifted rearward. The T-handle extends from the opposite end of the rod member. The T-handle is perpendicular to the rod member and has generally symmetrical right and left handle lobs (directions indicated from the perspective of an operator aiming the rifle) protruding in opposite directions to equal distances. The T-handle is designed and fashioned to be gripped using two fingers in the traditional embodiment.

Figure 1:
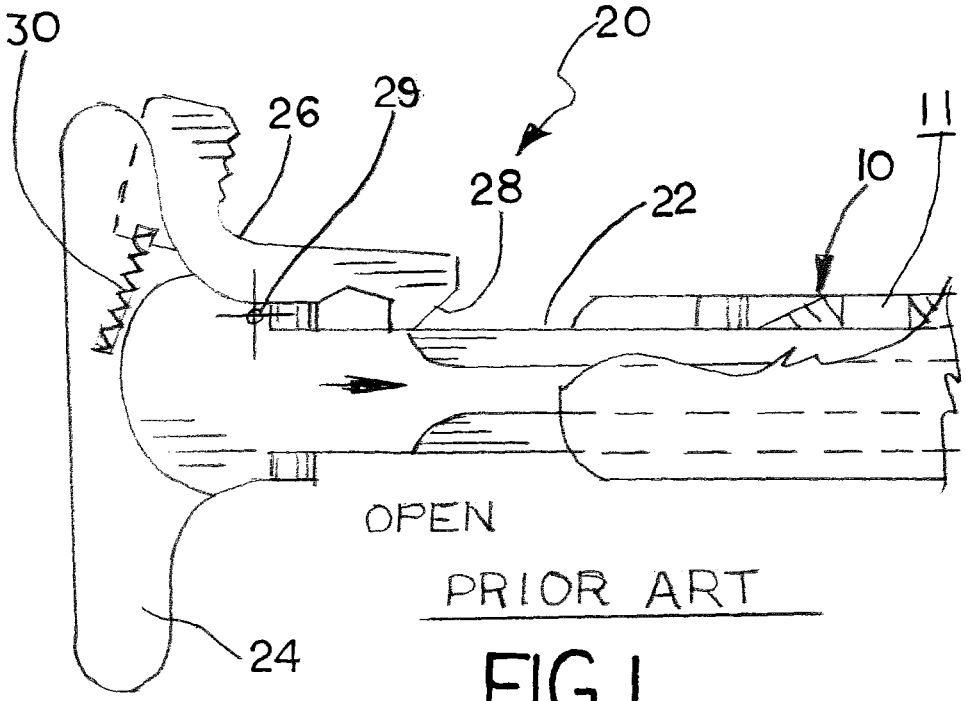
PRIOR ART FIG.1
FIG. 1 is a partial top view of a conventional M16/AR15 style charging handle in an open position in an upper receiver.
Figure 2:
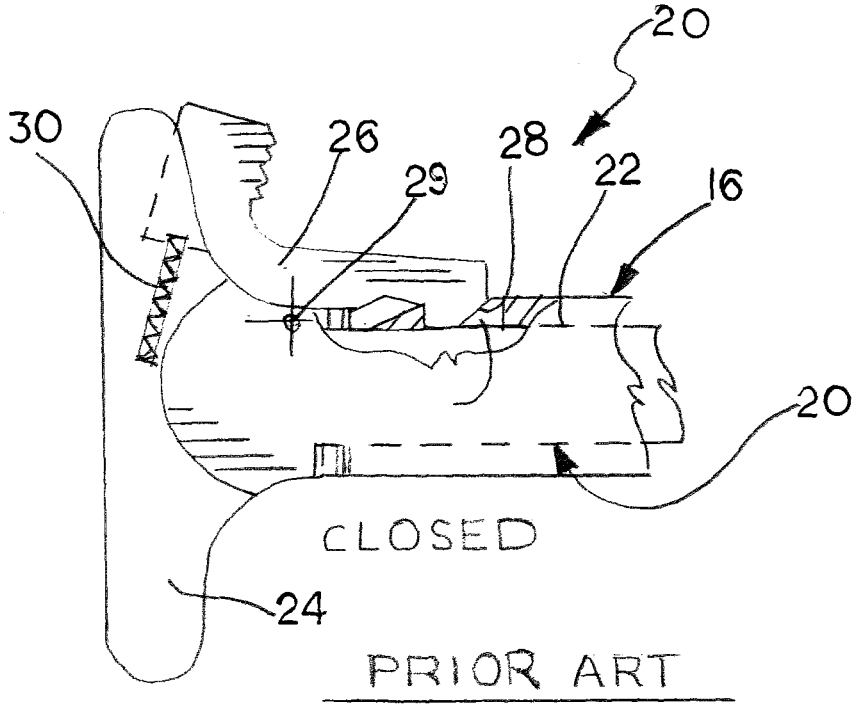
PRIOR ART FIG.2
FIG. 2 is a partial top view of a conventional M16/AR15 style charging handle in a closed position in an upper receiver.
Figure 3:
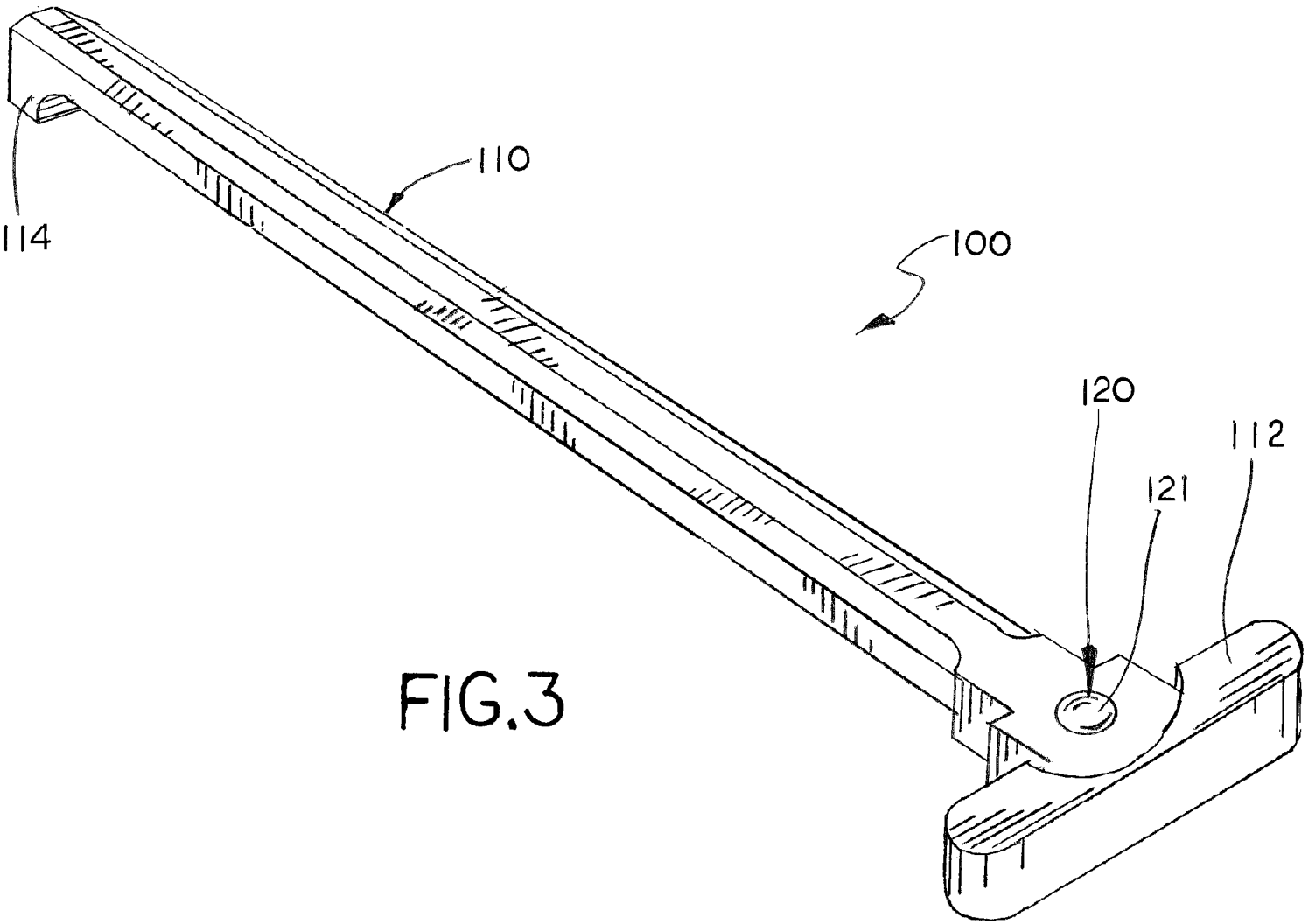
FIG. 3 is a perspective view of an embodiment of the charging handle assembly of this invention.
Figure 4:
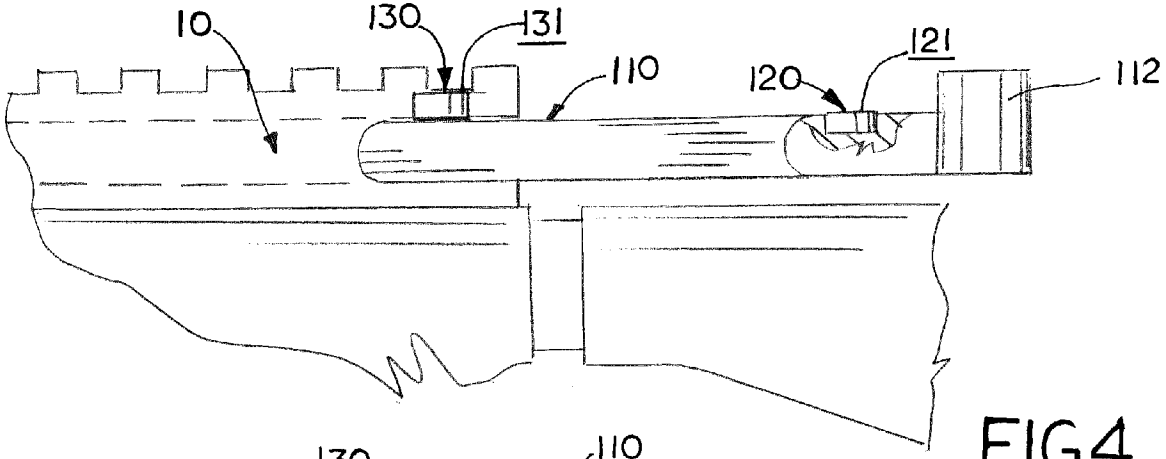
FIG. 4 is a partial side view of the charging handle assembly of FIG. 3 in an M16/AR-15 style weapon shown in an open position.
Figure 5:
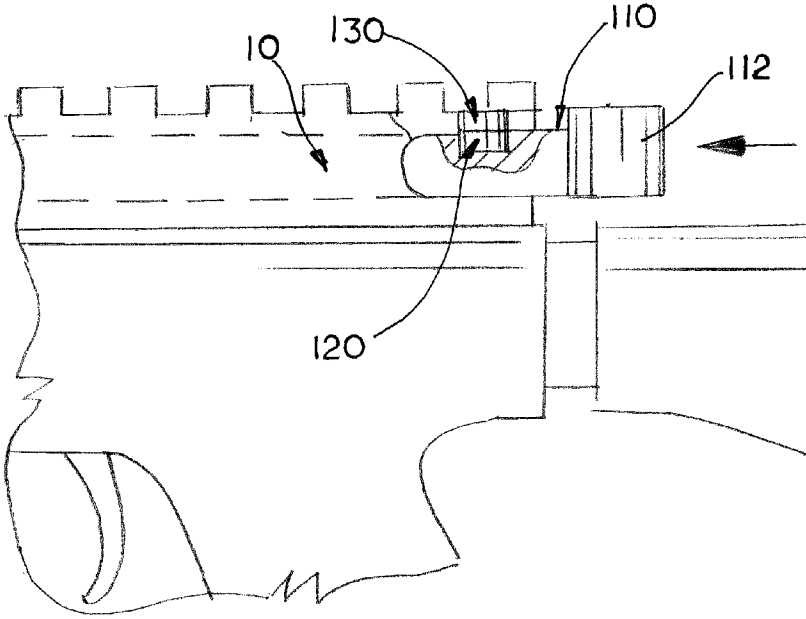
FIG. 5 is a partial side view of the charging handle assembly of FIG. 3 in an M16/AR-15 style weapon shown in a closed position.
Figure 6:
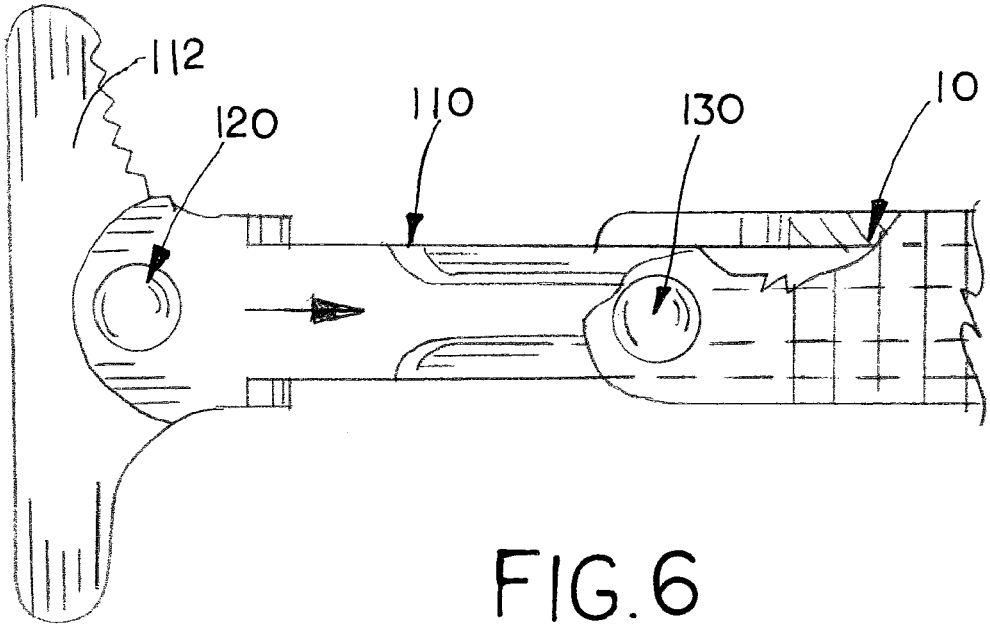
FIG. 6 is a partial top view of the charging handle assembly of FIG. 3 in an M16/AR-15 style upper receiver shown in an open position.
Figure 7:
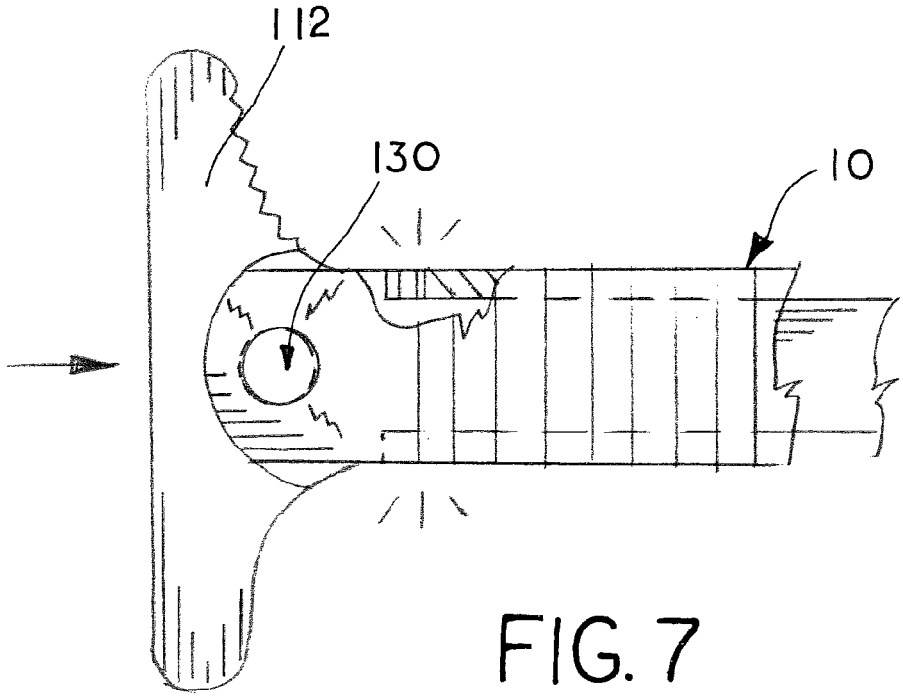
FIG. 7 is a partial top view of the charging handle assembly of FIG. 3 in an M16/AR-15 style upper receiver shown in a closed position.
Figure 8:
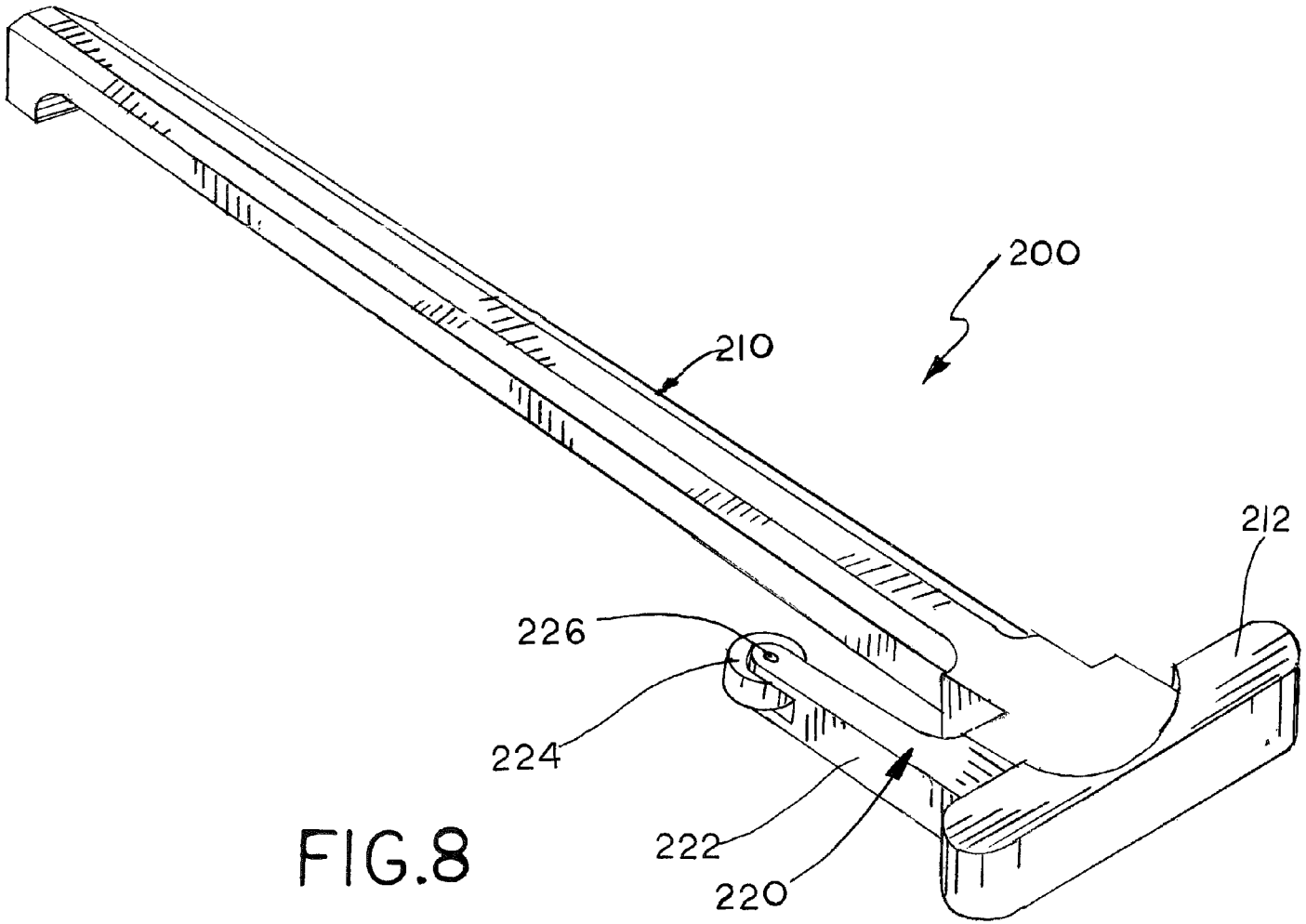
FIG. 8 is a perspective view of a second embodiment of the charging handle assembly of this invention.
Figure 9:
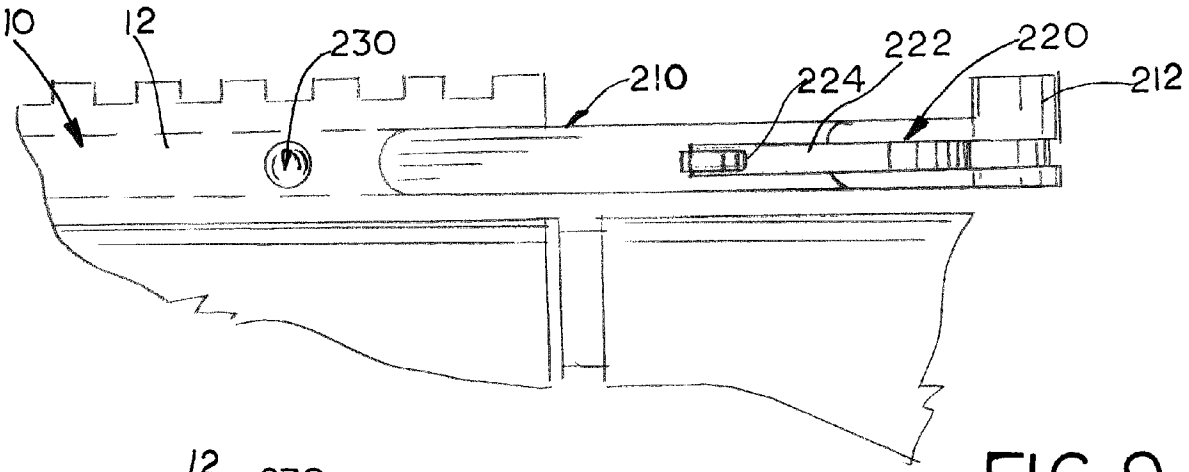
FIG. 9 is a partial side view of the charging handle assembly of FIG. 8 in an M16/AR-15 style weapon shown in an open position.

FIGS. 3-7 illustrate a first embodiment of the charging handle of this invention, which is designated generally as reference numeral 100. As shown, charging handle assembly 100 includes a T-shaped charging handle 110 and a pair of magnetically attracting plugs or screws 120 and 130 embedded in the upper receiver 10 of the charging handle. As shown, charging handle 110 includes an elongated pull rod and T-handle 112. The pull rod terminates in a hooked end 114, which is adapted to engage the bolt carrier assembly (not shown) within the upper receiver. As shown, magnetic plugs 120 and 130 take the form of a plug or button embedded in a vertical bore or cavity formed in receiver 10 or charging handle 110. One of plugs 120 or 130 is composed of oppositely poled magnetic material, such as an earth magnet, while the other is composed of a corresponding magnetic attracting material, such as a ferrous metal. Charging handle 110 has a vertical cavity 121 formed adjacent T-handle 116, within which magnetic plug 120 is seated. Upper receiver 10 is machined to have a vertical bore or cavity 131 located near the rear of the receiver rail, within which magnetic plug 130 is seated. Plugs 120 and 130 are generally press fit into cavities 121 and 131, respectively, but may be held in place by suitable adhesives. In other alternative embodiments, plugs 120 and 130 may take the form of threaded rods or screws that are turned into thread bores formed at similar locations in receiver 10 and charging handle 110. As shown, plugs 120 and 130 are spaced apart in the open position (FIGS. 4 and 6) and overlie one another when charging handle 100 is in the closed position (FIGS. 5 and 7). The magnetic attraction between the overlying plugs 120 and 130 securely locks charging handle 100 in the closed position.

Figure 10:
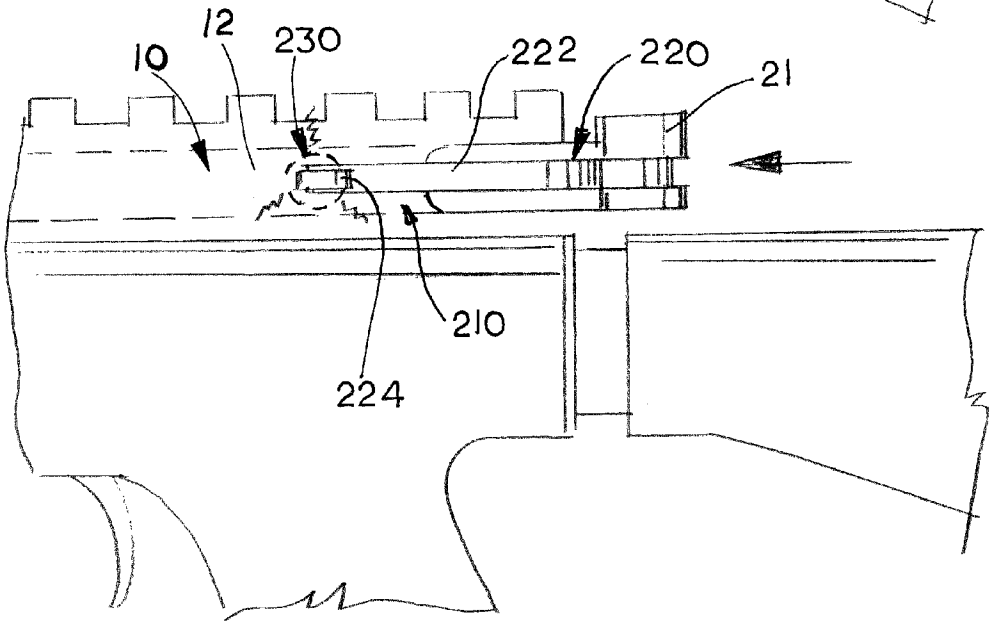
FIG. 10 is a partial side view of the charging handle assembly of FIG. 8 in an M16/AR-15 style weapon shown in a closed position.
Figure 11:
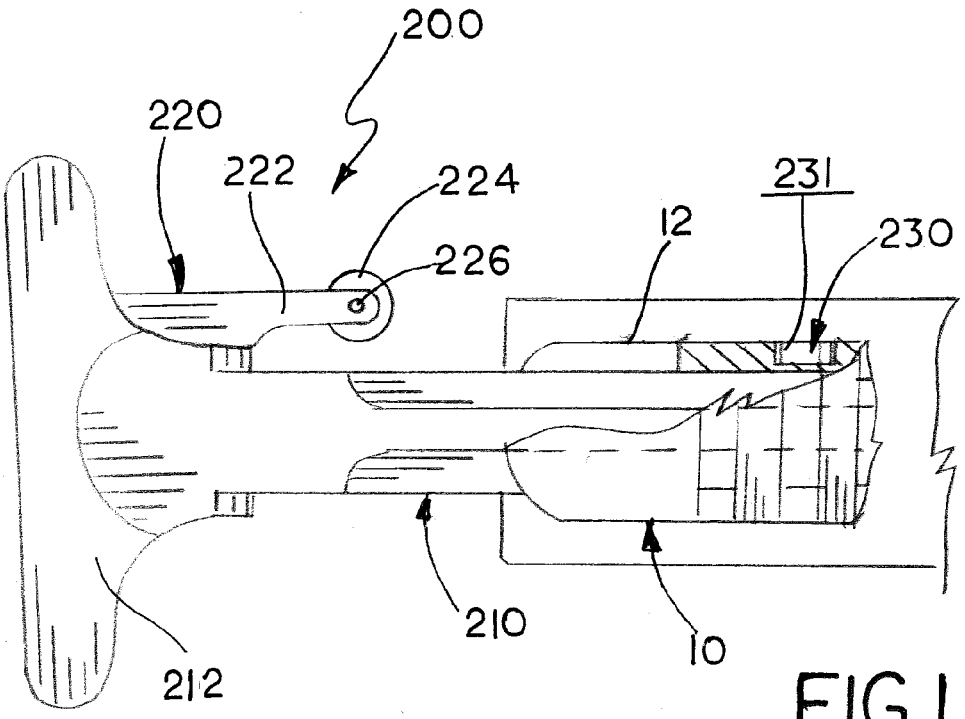
FIG. 11 is a partial top view of the charging handle assembly of FIG. 8 in an M16/AR-15 style upper receiver shown in an open position.
Figure 12:
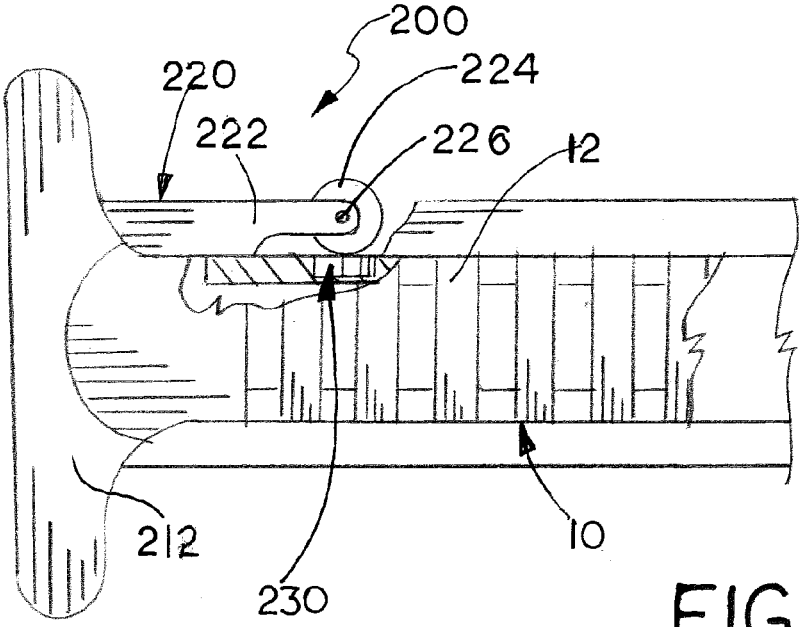
FIG. 12 is a partial top view of the charging handle assembly of FIG. 8 in an M16/AR-15 style upper receiver shown in a closed position.
Figure 13:
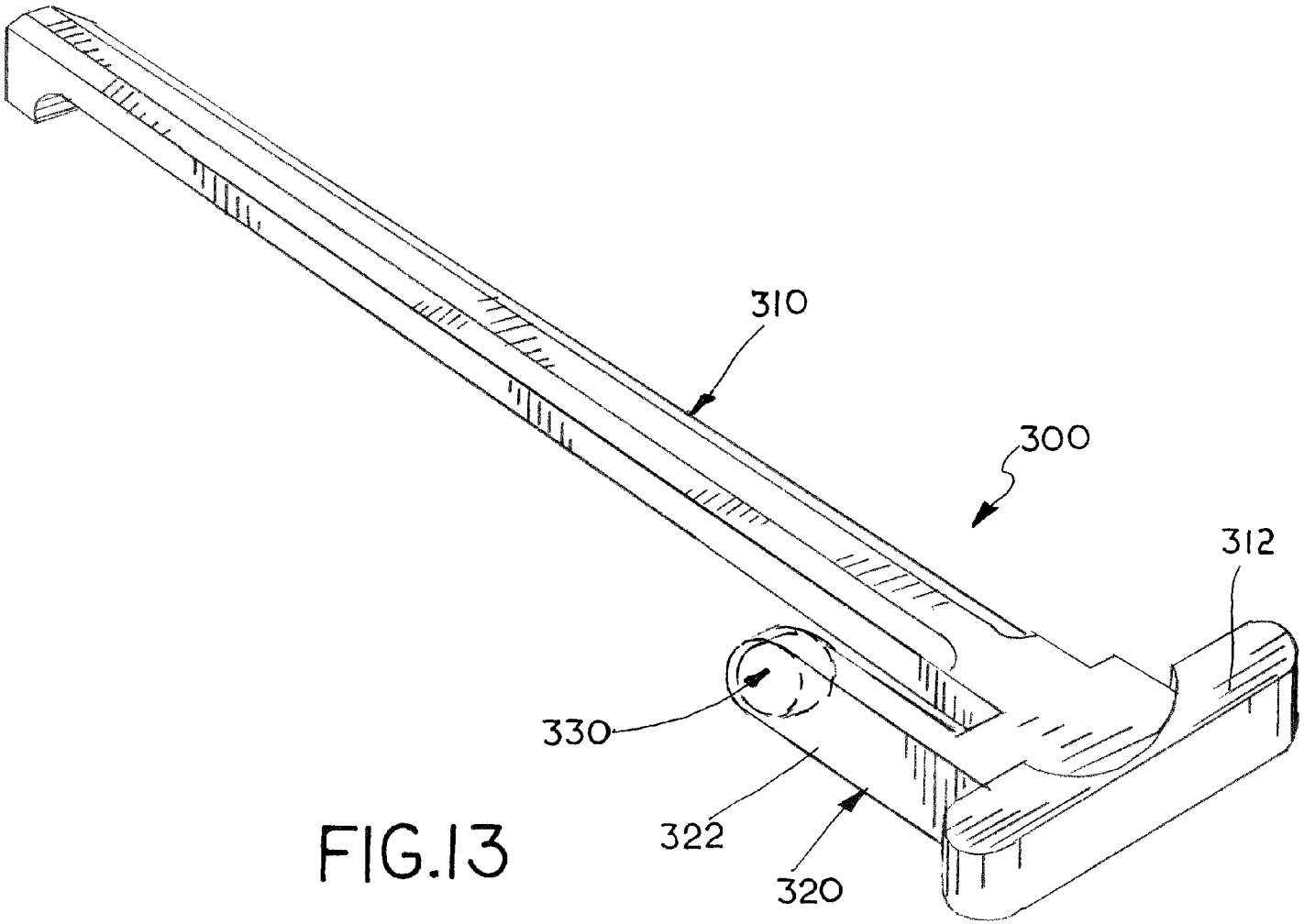
FIG. 13 is a perspective view of a third embodiment of the charging handle assembly of this invention.
Figure 14:
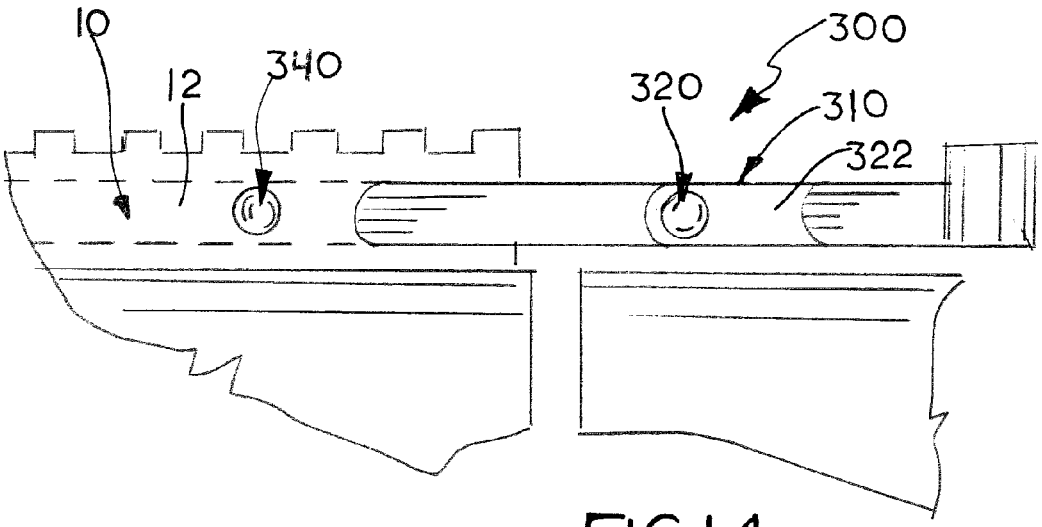
FIG. 14 is a partial side view of the charging handle assembly of FIG. 13 in an M16/AR-15 style weapon shown in an open position.

FIGS. 8-12 illustrate a second embodiment of the charging handle assembly of this invention, which is designated generally as reference numeral 200. As shown, charging handle assembly 200 has a magnetic latch mechanism 220 that includes an integral L-shaped arm 222 extending from the handle end of pull rod 210. As shown, arm 222 is spaced parallel to pull rod 210 so as to overlie the outside wall 12 of upper receiver 10 when charging handle 200 is in the closed position. A rotatable ferrous disc 224 is mounted to the distal end of arm 222 by a pin 226. Disc 224 is dimensioned and positioned to roll over the outside wall 12 of upper receiver 10 as the charging handle is moved into the closed position. A magnetic plug 230 is seated within a recessed opening formed in the outside wall 12 of the upper receiver 10. As shown, disc 224 and plugs 230 are spaced apart in the open position (FIGS. 9 and 11) and overlie one another when charging handle 100 is in the closed position (FIGS. 10 and 12). The magnetic attraction between the overlying disc 224 and plugs 230 securely locks charging handle 200 in the closed position.

Figure 15:
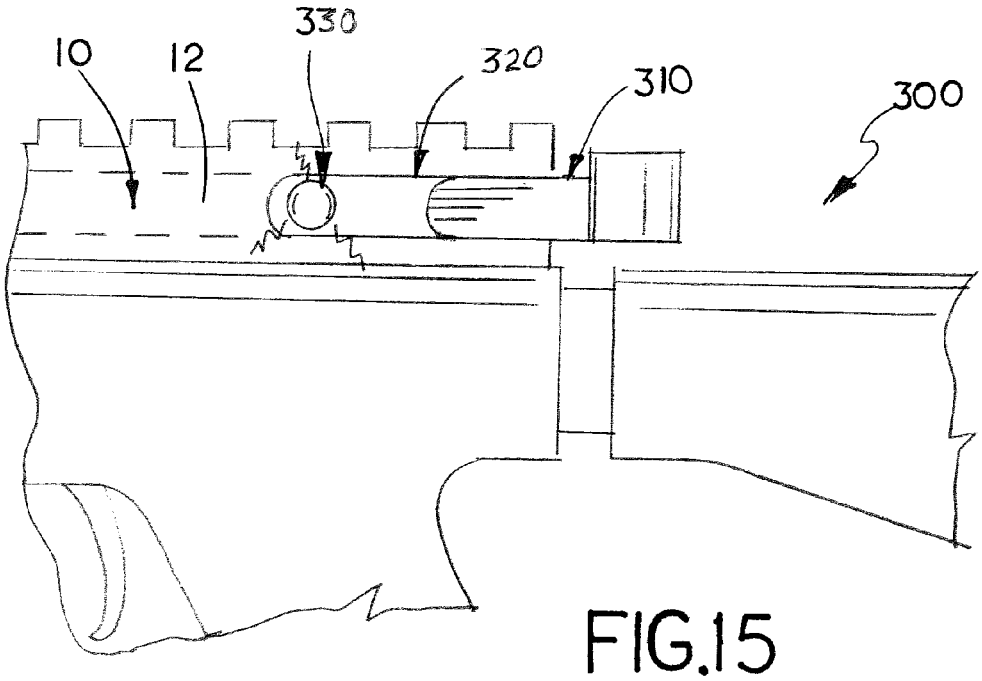
FIG. 15 is a partial side view of the charging handle assembly of FIG. 13 in an M16/AR-15 style weapon shown in a closed position.
Figure 16:
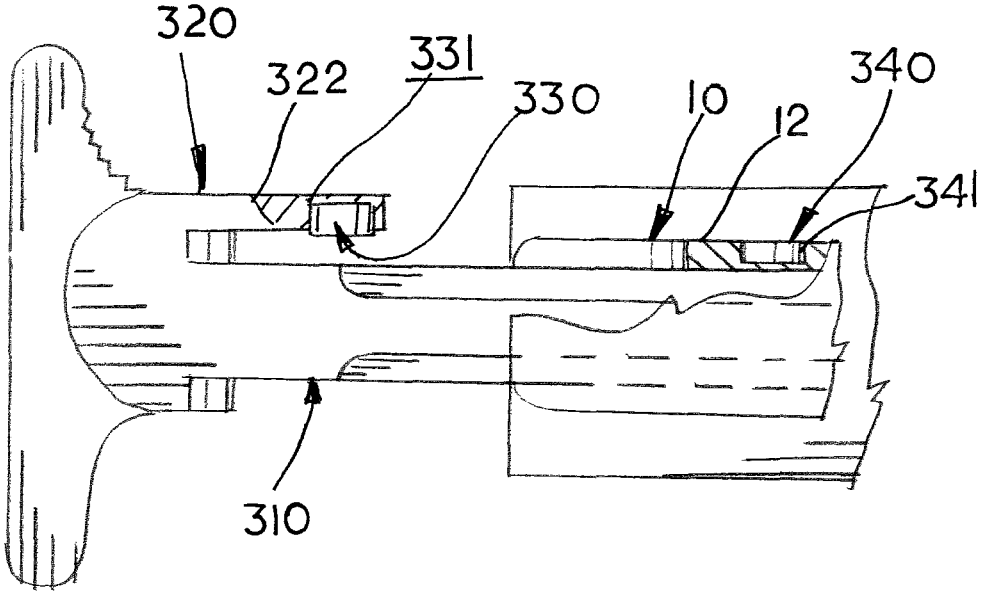
FIG. 16 is a partial top view of the charging handle assembly of FIG. 13 in an M16/AR-15 style upper receiver shown in an open position.
Figure 17:
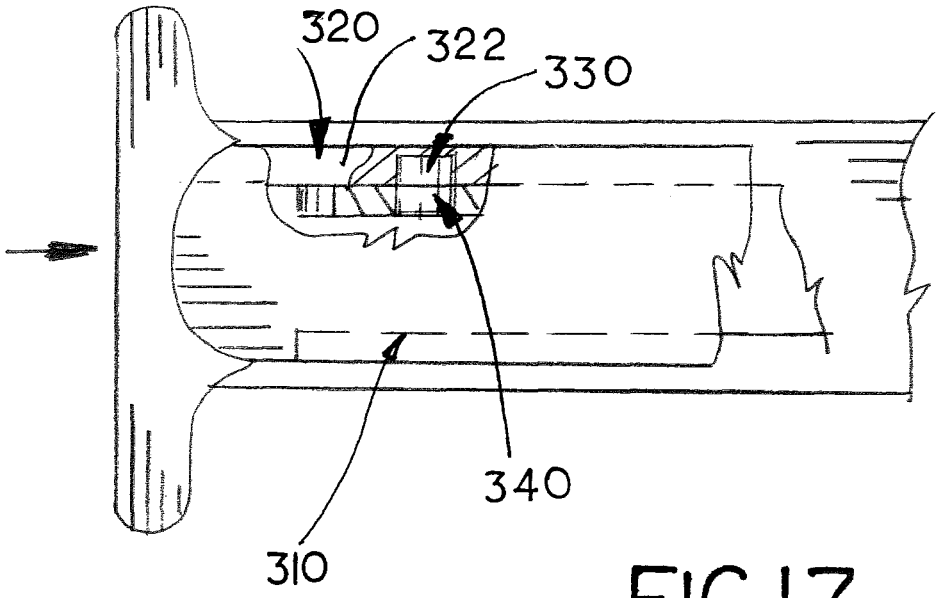
FIG. 17 is a partial top view of the charging handle assembly of FIG. 13 in an M16/AR-15 style upper receiver shown in a closed position.
Figure 18:
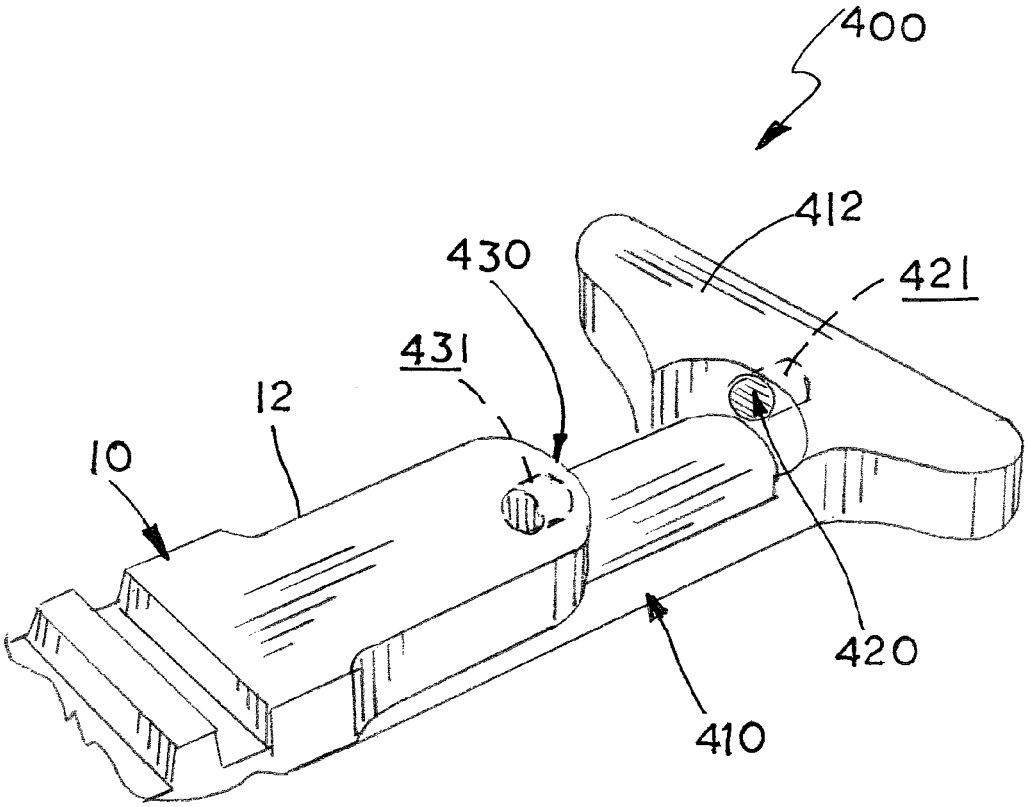
FIG. 18 is a perspective view of a fourth embodiment of the charging handle assembly of this invention.
Figure 19:
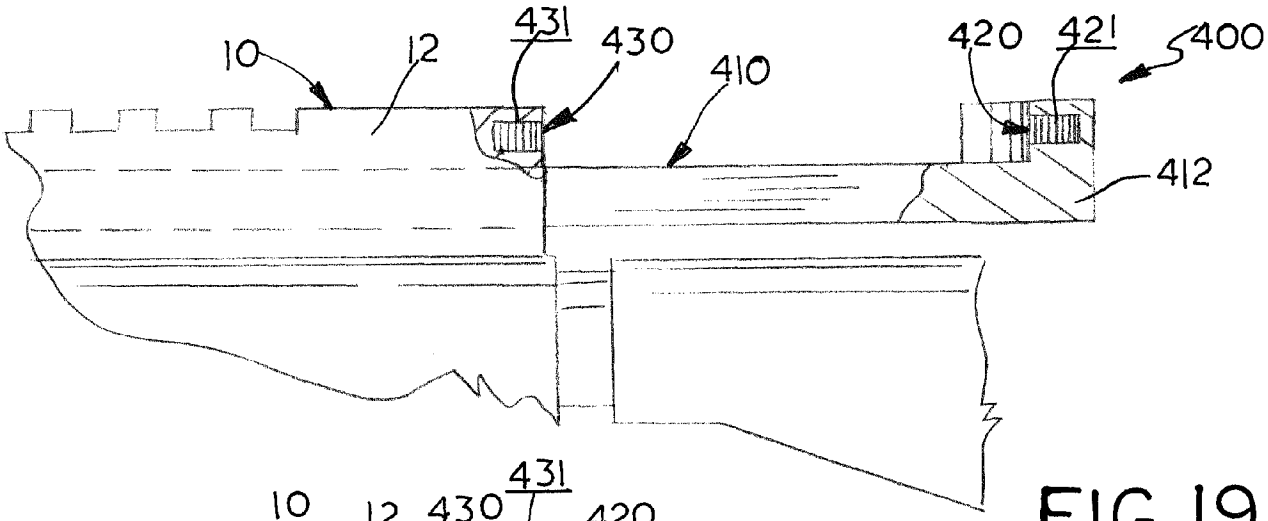
FIG. 19 is a partial side view of the charging handle assembly of FIG. 18 in an M16/AR-15 style weapon shown in an open position.

FIGS. 13-17 illustrate a third embodiment of the charging handle assembly of this invention, which is designated generally as reference numeral 300. Charging handle assembly 300 is similar to charging handle assembly 200 described above in design and function, except that the rolling disc is replaced by a simple plug. As shown, the magnetic latch mechanism 320 of charging handle assembly 300 has a ferrous plug 300 seated in a recessed opening in the inside face of arm 322. As with charging handle 200, the charging handle 300 has an integral L-shaped arm 322 extending from the handle end of pull rod 310. Again, a magnetic plug 330 is seated within a recessed opening formed in the outside wall 12 of the upper receiver 10. As shown, plugs 320 and 330 are spaced apart in the open position (FIGS. 14 and 16) and overlie one another when charging handle 300 is in the closed position (FIGS. 15 and 17). The magnetic attraction between the overlying plugs 320 and 330 securely locks charging handle 300 in the closed position.

Figure 20:
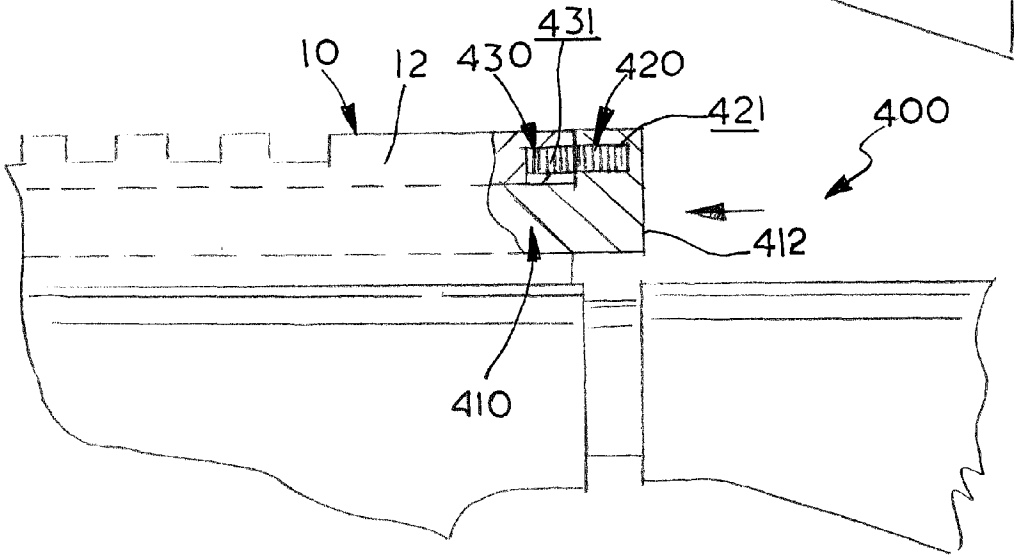
FIG. 20 is a partial side view of the charging handle assembly of FIG. 18 in an M16/AR-15 style weapon shown in a closed position.
Figure 21:
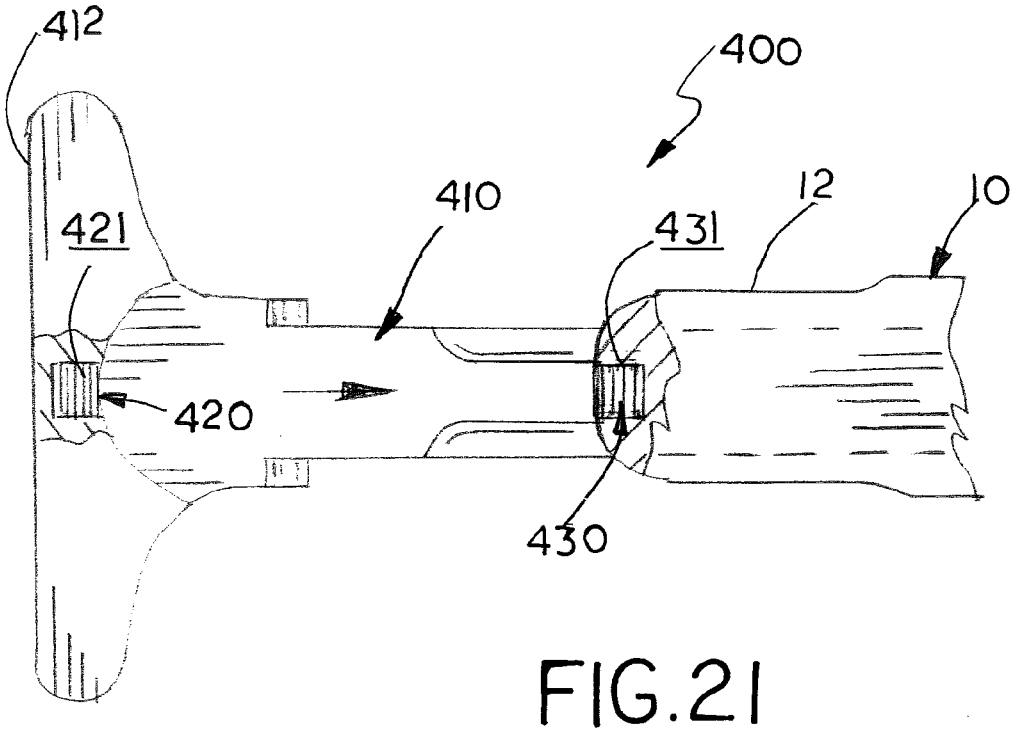
FIG. 21 is a partial top view of the charging handle assembly of FIG. 18 in an M16/AR-15 style upper receiver shown in an open position.
Figure 22:
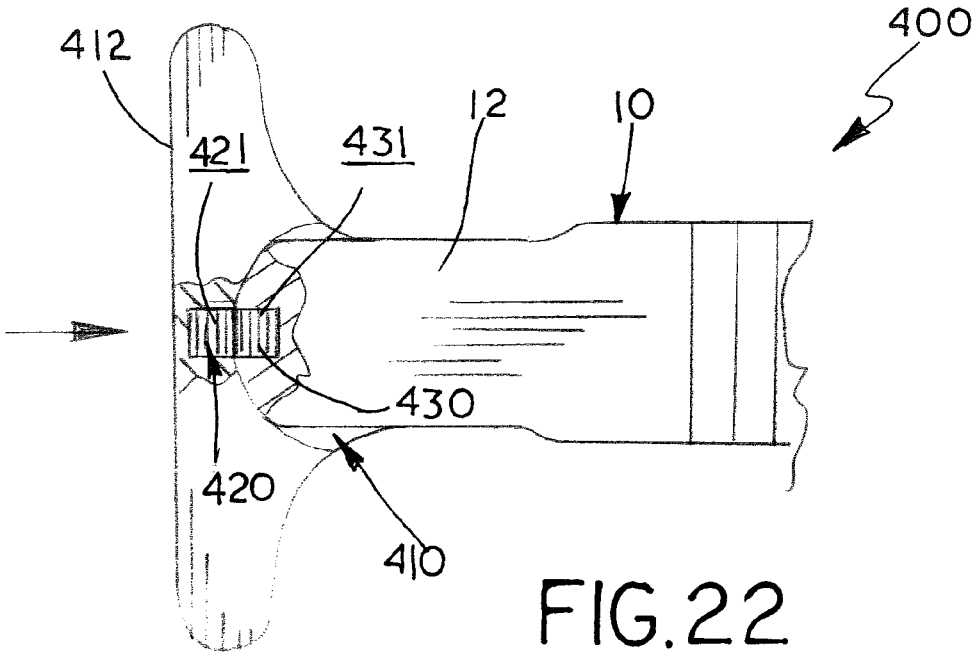
FIG. 22 is a partial side view of the charging handle assembly of FIG. 18 in an closed position in an M16/AR-15 style upper receiver.
Figure 23:
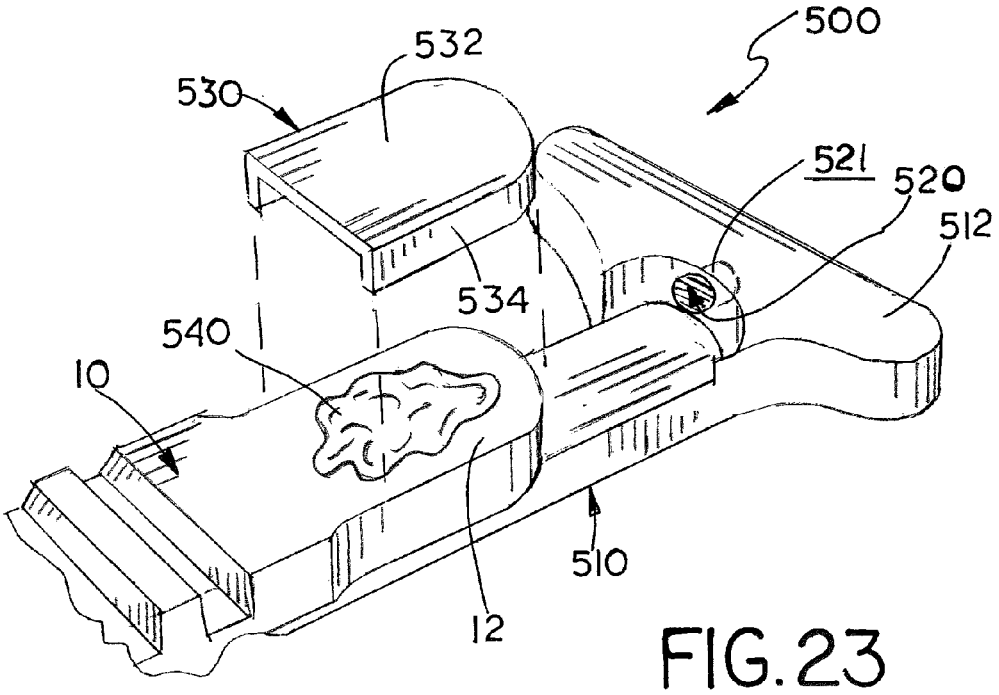
FIG. 23 is a perspective view of a fifth embodiment of the charging handle assembly of this invention shown in an open position.
Figure 24:
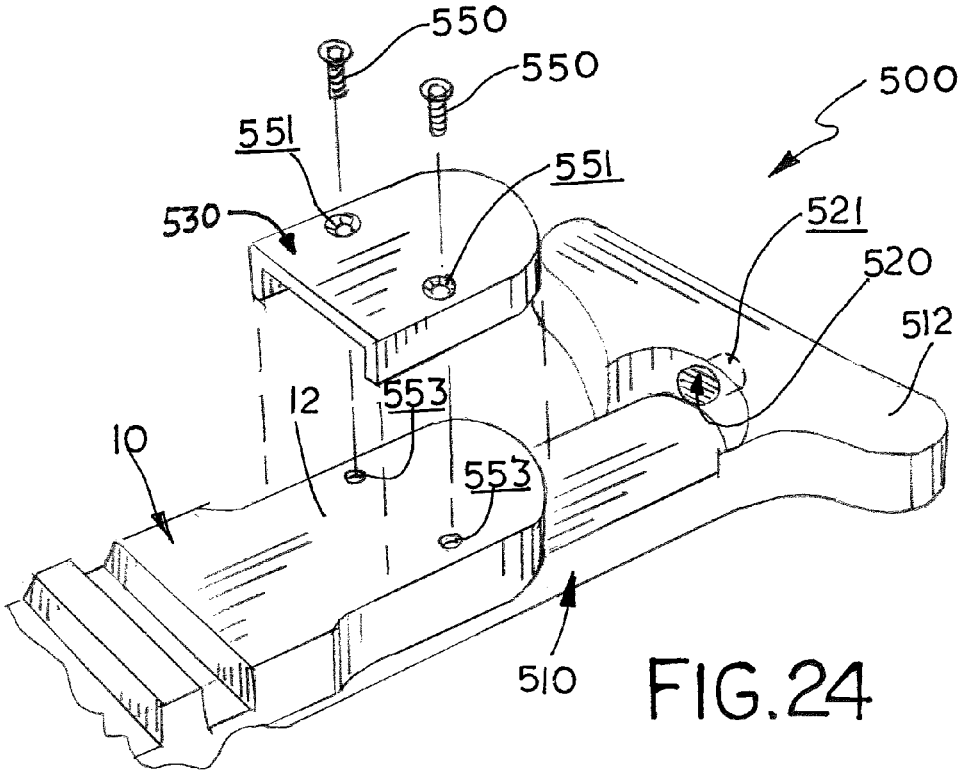
FIG. 24 is another perspective view of the charging handle assembly of FIG. 23 this invention.
Figure 25:
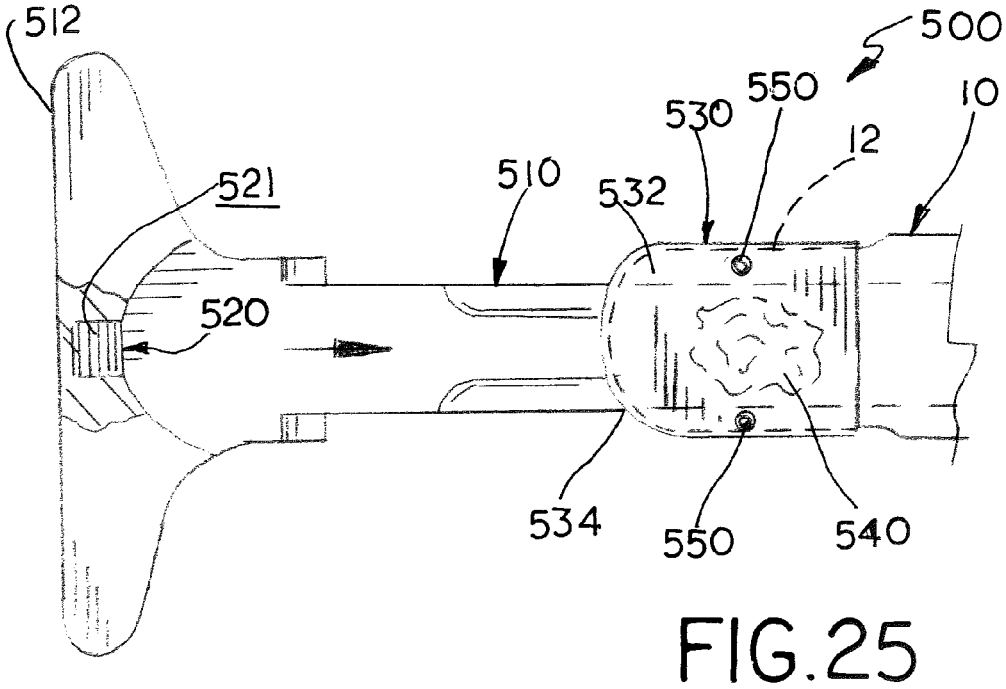
FIG. 25 is a partial top view of the charging handle of FIG. 18 in an M16/AR-15 style upper receiver shown in an open position.

FIGS. 18-22 illustrate a fourth embodiment of the charging handle of this invention, which is designated generally as reference numeral 400. As shown, charging handle assembly 400 is similar in design and function to charging handle assembly 100 described above, and differs only in the location of the attracting magnetic plugs. As shown, charging handle assembly 400 includes a T-shaped charging handle 410 and a pair of magnetically attracting plugs 420 and 430 that take the form of threaded rods seated within threaded lateral bores formed in receiver 10 and charging handle 410. Again, one of plugs 420 or 430 is composed of oppositely poled magnetic material, such as earth magnet, while the other plug is composed of a corresponding magnetic attracting material, such as a ferrous metal. Charging handle 410 has a lateral thread bore 421 formed in the curved central wall of the T-handle, within which magnetic plug 420 is seated. Upper receiver 10 is machined to have a lateral threaded bore 431 extending into rear rail end 12 of the receiver, within which magnetic plug 430 is seated. As shown, plugs 420 and 430 are spaced apart in the open position (FIGS. 18, 19 and 21) and overlie one another when charging handle 410 is in the closed position (FIGS. 20 and 22). The magnetic attraction between the overlying plugs 420 and 430 securely locks charging handle 410 in the closed position.

Figure 26:
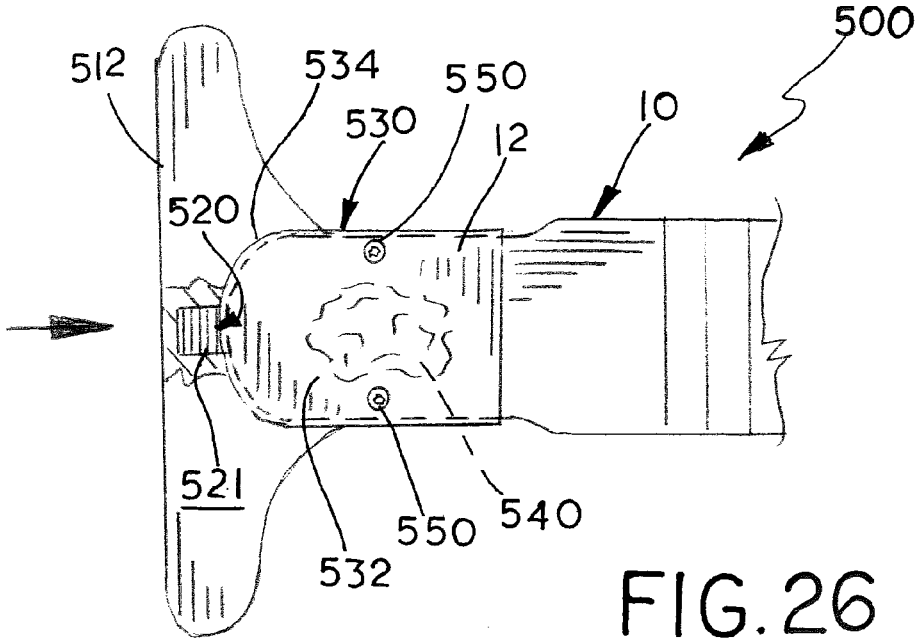
FIG. 26 is a partial top view of the charging handle of FIG. 18 in an M16/AR-15 style upper receiver shown in a closed position.
Figure 27:
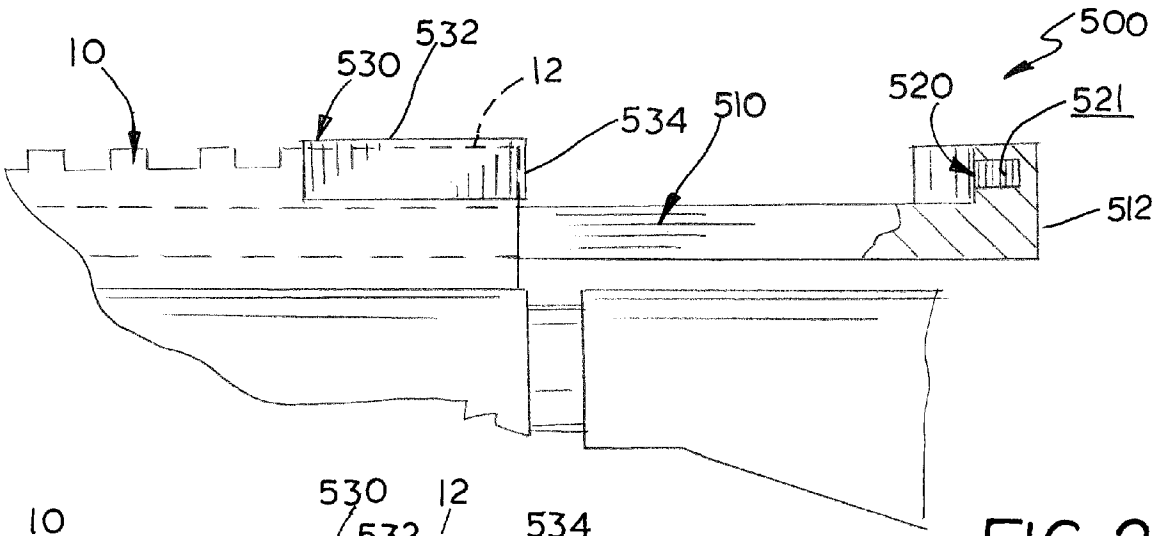
FIG. 27 is a partial side view of the charging handle of FIG. 18 in an M16/AR-15 style weapon shown in an open position.
Figure 28:
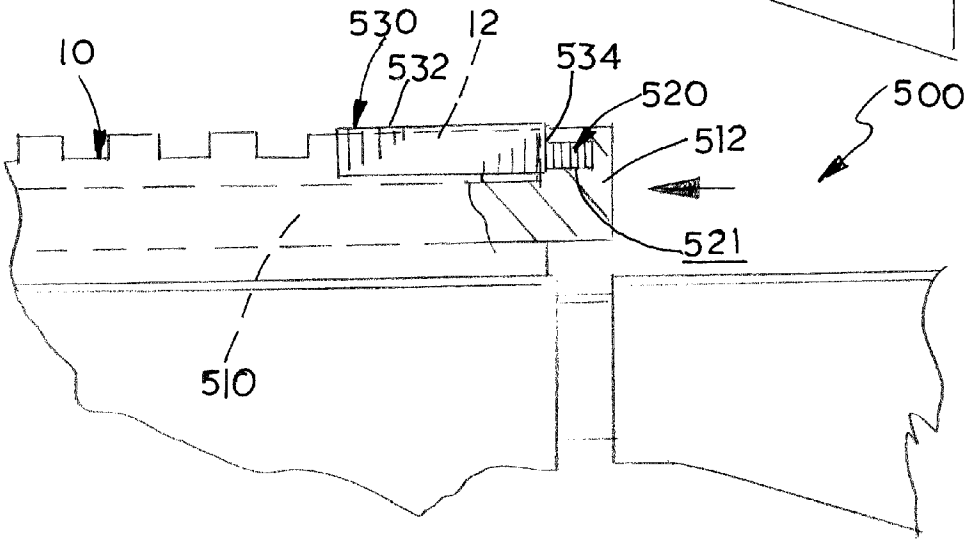
FIG. 28 is a partial side view of the charging handle of FIG. 18 in an M16/AR-15 style weapon shown in a closed position.

FIGS. 23-28 illustrate a fifth embodiment of the charging handle of this invention, which is designated generally as reference numeral 500. As shown, charging handle assembly 500 includes a T-shaped charging handle 510, a magnetic plug 520 embedded in the charging handle, and a metal cap 530 mounted over rear rail end 12 of upper receiver 10. Charging handle 510 and magnetic plug 520 are identical to that used in charging handle assembly 400 described above. Plug 520 is a threaded rod composed of oppositely poled magnetic material, such as an earth magnet. Charging handle 510 has a lateral thread bore 521 formed in the curved central wall of the T-handle, within which magnetic plug 520 is seated. Cap 530 is machined or stamped from a ferrous metal and configured to nest over the rail end of upper receiver 10. As shown, cap 530 has a flat top wall 532 and a peripheral side wall 534. Cap 530 is secured to receiver 10 by a suitable adhesive 540 and set screws 550 that extend through bores 551 in cap top 532 and threaded bores 553 tapped into the top of rear rail end 12. As shown, plug 520 and cap 530 are spaced apart in the open position (FIGS. 23-25 and 27) and abut against one another when charging handle 510 is in the closed position (FIGS. 26 and 28). The magnetic attraction between plug 520 and cap 530 securely locks charging handle 410 in the closed position.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A charging handle assembly for a weapon having a receiver, the assembly comprising:

a charging handle operatively mounted to the receiver for extensible movement between an open position and a closed position; and a latch mechanism for securing the charging handle in the closed position, the latch mechanism includes a first magnetically attracting part mounted to the receiver, and a second magnetically attracting part mounted to the charging handle where the first magnetically attracting part and the second magnetically attracting part are proximally located to one another to magnetically attract one another when the charging handle is in the closed position to thereby secure the charging handle in the closed position, and where the second magnetically attracting part is spaced from the first magnetically attracting part when the charging handle is in the open position.

2. The latch mechanism of claim 1 wherein one of the first magnetically attracting part and the second magnetically attracting part is composed of oppositely poled magnetic material, and the other of the first magnetically attracting part and the second magnetically attracting part is composed of a magnetically attracting material.

3. The assembly of claim 1 wherein the first magnetically attracting part is embedded within the receiver, and the second magnetically attracting part is embedded within the charging handle.

4. The assembly of claim 1 wherein the first magnetically attracting part is embedded within the receiver.

5. The assembly of claim 4 wherein the second magnetically attracting part extends from charging change to overlie the first magnetically attracting part when the charging handle is in the closed position.

6. The assembly of claim 1 wherein the charging handle includes an elongated pull rod, a handle connected to the pull rod, and an arm extending from and parallel to the pull rod, the second magnetically attracting part mounted to the arm.

7. The assembly of claim 6 wherein the second magnetically attracting part is a rotatable disc.

8. The assembly of claim 1 wherein the first magnetically attracting part is a cap affixed to the receiver.

9. A firearm comprising:

a receiver;

a charging handle operatively mounted to the receiver for extensible movement between an open position and a closed position; and a latch mechanism for securing the charging handle in the closed position, the latch mechanism includes a first magnetically attracting part mounted to the receiver, and a second magnetically attracting part mounted to the charging handle where the first magnetically attracting part and the second magnetically attracting part are proximally located to one another to magnetically attract one another when the charging handle is in the closed position to thereby secure the charging handle in the closed position, and where the second magnetically attracting part is spaced from the first magnetically attracting part when the charging handle is in the open position.

10. the latch mechanism of claim 9 wherein one of the first magnetically attracting part and the second magnetically attracting part is composed of oppositely poled magnetic material, and the other of the first magnetically attracting part and the second magnetically attracting part is composed of a magnetically attracting material.

11. The firearm of claim 9 wherein the receiver has a receiver bore therein, the first magnetically attracting part is embedded within the receiver bore.

12. The firearm of claim 9 wherein the charging handle has a handle bore therein, the second magnetically attracting part is embedded within the handle bore.

13. The firearm of claim 9 wherein the first magnetically attracting part is a cap affixed to the receiver.

14. A charging handle assembly for a weapon having a receiver, the assembly comprising:

a charging handle operatively mounted to the receiver for extensible movement between an open position and a closed position; and a latch mechanism for securing the charging handle in the closed position, the latch mechanism includes a first magnetically attracting part adapted mounted to the receiver, and a second magnetically attracting part mounted to the charging handle where the second magnetically attracting part is approximate the first magnetically attracting part when the charging handle is in the closed position and where the second magnetically attracting part is spaced from the first magnetically attracting part when the charging handle is in the open position, the charging handle includes an elongated pull rod, a handle connected to the pull rod, and an arm extending from and parallel to the pull rod, the second magnetically attracting part mounted to the arm, the second magnetically attracting part is a rotatable disc.

15. A firearm comprising:

a receiver;

a charging handle operatively mounted to the receiver for extensible movement between an open position and a closed position; and a latch mechanism for securing the charging handle in the closed position, the latch mechanism includes a first magnetically attracting part mounted to the receiver, and a second magnetically attracting part mounted to the charging handle where the second magnetic attracting part is approximate the first magnetic attracting part when the charging handle is in the closed position and where the second magnetic attracting part is spaced from the first magnetic attracting part when the charging handle is in the open position, the receiver has a receiver bore therein, the first magnetically attracting part is embedded within the receiver bore.

16. A firearm comprising:

a receiver;

a charging handle operatively mounted to the receiver for extensible movement between an open position and a closed position; and a latch mechanism for securing the charging handle in the closed position, the latch mechanism includes a first magnetically attracting part mounted to the receiver, and a second magnetically attracting part mounted to the charging handle where the second magnetically attracting part is approximate the first magnetically attracting part when the charging handle is in the closed position and where the second magnetically attracting part is spaced from the first magnetically attracting part when the charging handle is in the open position, the first magnetically attracting part is a cap affixed to the receiver.

* * * * *